United States Patent [19]

Michitoshi et al.

[11] Patent Number: 5,075,939

[45] Date of Patent: Dec. 31, 1991

[54] SHEET SUPPLYING DEVICE

[75] Inventors: Akao Michitoshi; Takashi Nakata, both of Nagoya, Japan

[73] Assignee: Brother Kogyo Kabushiki Kaisha, Japan

[21] Appl. No.: 602,695

[22] Filed: Oct. 24, 1990

[30] Foreign Application Priority Data

Dec. 29, 1989 [JP] Japan ..... 1-341636

[51] Int. Cl.[5] ..... B65H 3/34

[52] U.S. Cl. ..... 271/104; 271/106; 271/108; 271/265; 271/266; 271/110

[58] Field of Search ..... 271/102, 103, 104, 106, 271/107, 108, 11, 12, 110, 246, 245, 265, 266, 273

[56] References Cited

U.S. PATENT DOCUMENTS

| | | | |
|---|---|---|---|
| 2,185,652 | 1/1940 | Spiess | 271/106 |
| 3,637,203 | 1/1972 | French | 271/246 |
| 4,621,800 | 11/1986 | Bayer et al. | 271/182 |
| 4,637,598 | 1/1987 | Bouwens et al. | 271/265 |
| 4,730,823 | 3/1988 | Barela et al. | 271/103 |
| 4,848,764 | 7/1989 | Tajima | 271/107 |
| 4,968,019 | 11/1990 | Tanabe et al. | 271/106 |

FOREIGN PATENT DOCUMENTS

| | | | |
|---|---|---|---|
| 110439 | 4/1989 | Japan | 271/107 |

*Primary Examiner*—H. Grant Skaggs
*Attorney, Agent, or Firm*—Oliff & Berridge

[57] ABSTRACT

A sheet feeding system for ensuring feed of a single sheet includes a suction cup for holding the uppermost sheet of a stack. During initial lifting of the sheet, movement of the suction cup is halted for a predetermined time to allow sheets which have clung, by static attraction or otherwise to the uppermost sheet, to return to the stack. The initial lifting of the sheet takes place by swinging the suction cup about an axis. Thereafter the suction cup is lifted vertically to bring the topmost sheet into position to be taken up by portion feeding rollers and fed into a feed path. A stack empty detector employs a swinging arm which is positioned above the position the position of initial displacement of the suction cup so that, even if the last few sheets of the stack are initially attracted by the suction cup, the indicator will be prevented from giving a spurious "stack empty" signal.

19 Claims, 8 Drawing Sheets

SHEET SUPPLYING DEVICE

BACKGROUND OF THE INVENTION

1. Field of the Invention

The present invention relates to a sheet supplying device for supplying a sheet from a sheet cassette to a sheet feed path of an image forming apparatus such as a copying machine.

2. Description of Related Art

A sheet supplying device is proposed as described in U.S. Pat. No. 4,968,019, issued Nov. 6, 1990. The proposed sheet supplying device has an array of suction cups into and out of contact with an uppermost one of stacked sheets in a sheet cassette. After the suction cups are held against the uppermost sheet, a vacuum is developed in the suction cups to enable the suction cups to attract the uppermost sheet. Then, the suction cups are raised with the uppermost sheet attracted thereto, and a leading end of the attracted and raised uppermost sheet is nipped, and the sheet is delivered into a sheet feed path. When the suction cups are raised, they are angularly moved about an axis to cause the leading end of the attracted uppermost sheet to be obliquely separated from other stacked sheets.

However, in the proposed sheet supplying device, when suction cups are raised attracting the uppermost sheet, a plurality of sheets under the uppermost sheet are raised with the uppermost sheet by the static electricity generated between sheets and are fed to the sheet feed path.

SUMMARY OF THE PRESENT INVENTION

In order to solve the above drawbacks of the above mentioned sheet supplying devices, it is an object of the present invention to provide a sheet supplying device which can separate the uppermost sheet from the sheets stacked in sheet cassette and can supply it without a sheet jam.

To achieve the object, a sheet supplying device according to this invention comprises: a sheet cassette for stacking sheets; a suction cup movable into and out of contact with the uppermost sheet in said sheet cassette; evacuating means for developing a negative pressure in said suction cup to enable said suction cup to attract the uppermost sheet; elevator means for moving said suction cup upwardly and downwardly; first control means for controlling said elevator means to move said suction cup downwardly until said suction cup contacts with the uppermost sheet of the sheets stacked in said sheet cassette; second control means for controlling said elevator means to raise said suction cup slightly and then to stop said suction cup temporarily; and third control means for controlling said elevator means to raise said suction cup to a predetermined position.

In the sheet supplying device of this invention, the suction cup which attracts the uppermost sheet of the sheets stacked in the sheet cassette is raised slightly by the elevator means, and then stopped temporarily. At this time, sheets except an uppermost sheet fall on the sheet cassette again even if a plurality of sheet are attracted with the uppermost sheet by the static electricity. After that, the suction cup further moves upwardly to the predetermined position by the elevator means.

As a result, only an uppermost sheet is separated from the stacked sheets and supplied to the sheet feed path.

BRIEF DESCRIPTION OF THE DRAWINGS

A preferred embodiment of the present invention will be described in detail with reference to the following figures wherein.

DETAILED DESCRIPTION OF THE PREFERRED EMBODIMENTS

An embodiment will be described in which the present invention is employed in a developer sheet feeding device for a copying machine. The copying machine comprises a photosensitive pressure-sensitive copying machine capable of copying full-color images. The copying machine employs a continuous photosensitive pressure-sensitive recording medium such as a photosensitive microcapsule sheet for recording a latent image thereon, and a developer sheet for receiving a developed color image from the microcapsule sheet. The photosensitive microcapsule sheet and the developer sheet are disclosed in U.S. Pat. No. 4,399,209, for example, and will not be described in detail below.

Figure 3:
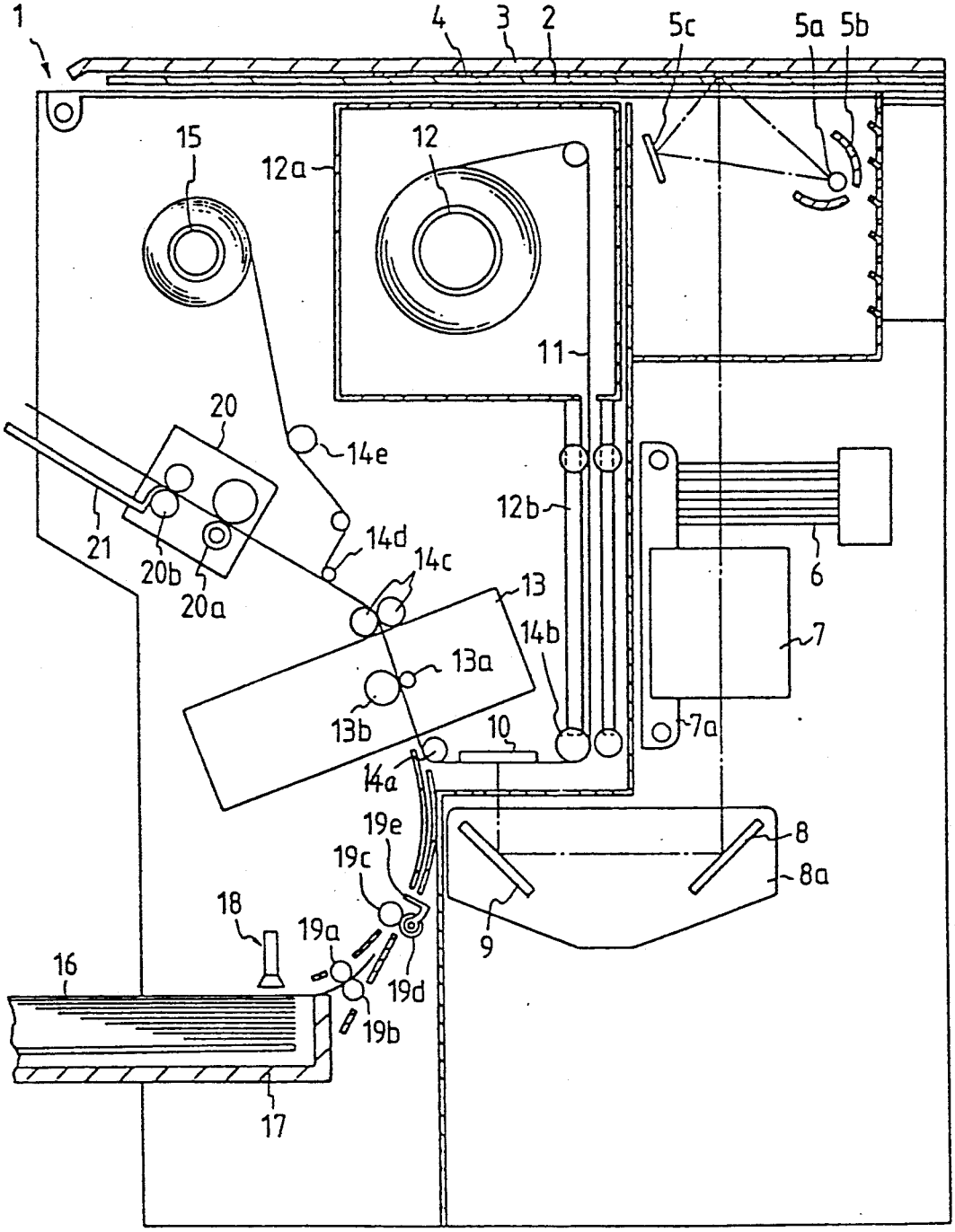
FIG. 3 is a schematic vertical cross-sectional view showing a copying machine incorporating the sheet supplying device.

As shown in FIG. 3, the copying machine 1 includes an upper panel assembly having an original support stand glass 2 which is movable back and forth and an original support stand glass cover 3 that can be placed over the original support stand glass 2. An original to be copied is put on the original support stand glass 2 which is formed of light transmissive material.

The copying machine also has a light source placed in an upper righthand portion thereof below the original support stand glass 2 and comprising a halogen lamp 5*a* extending in a direction normal to the direction in which the original support stand glass 2 is movable back and forth, and a semicylindrical reflecting mirror 5*b* disposed in surrounding relation to the halogen lamp 5*a*. The light source emits a linear-line light toward the lower surface of the original support stand glass 2.

When the original support stand glass 2 moves, the light emitted from the halogen lamp 5*a* continuously irradiates the entire surface of the original support stand glass 2 from the lefthand to the righthand end thereof (as shown in FIG. 3). The light from the light source passes through the transparent original support stand glass 2, and is then reflected by the original placed on the original support glass 2. The original support stand glass cover 3 covers the entire upper surface of the original support stand glass 2 so the light applied to the original support stand glass 2 will not leak out from those areas of the original support stand glass 2 which are not covered by the original.

A reflector 5c is positioned on the lefthand side of the light source for applying light emitted from the halogen lamp 5a to the original highly efficiently. The reflector 5b reflects those emitted light which are not directed toward the original support stand glass 2.

The light reflected from the original on the original support stand glass 2 is directed downwardly and passes through a filter 6 and a lens 7. The filter 6 serves to pass a desired wavelength of light dependent on the sensitivity of a microcapsule sheet 11 for adjusting the colors of a copied image. The lens 7 is mounted on a lens attachment 7a which is slightly angularly adjustable with respect to the path of the light through the filter 6 and the lens 7.

The light converged by the lens 7 is directed 180° back by two reflecting mirrors 8, 9 and then focused on the microcapsule sheet 11 held closely against the lower surface of an exposure table !0. The reflecting mirrors 8, 9 are mounted on a mirror attachment 8a which is adjustable to vary the length of the light path and change the focus.

The microcapsule sheet 11 is of a continuous elongate length and is wound around a cartridge reel 12 which is placed in a removable cartridge 12a positioned below the original support stand glass 2. A leading end portion of the microcapsule sheet extends through several rollers and a pressure developing unit 13 toward a takeup reel 15.

More specifically, the microcapsule sheet 11 drawn out of the cartridge 12a from an opening in the lower side of the cartridge, is fed and guided by feed rollers 14a and 14b, and extends beneath the exposure table 10 into the pressure developing unit 13. The microcapsule sheet 11 which has passed through the pressure developing unit 13 is fed by a pair of feed rollers 14c, travels past a separator roller 14d and an adjustment roller 14e, and is then wound around the takeup reel 15. The microcapsule sheet 11 discharged from the cartridge 12a is protected from exposure by a light-shielding cover 12b before the microcapsule sheet 11 reaches the exposure table 10.

The speed at which the microcapsule sheet 11 is fed is controlled so as to be held at a constant level, and is maintained at the same speed at which the original support stand glass 2 is moved. Therefore, a latent image can be formed successively line by line on the microcapsule sheet 11 when it moves past the exposure table 10.

A developer sheet cassette 17 storing a stack of developer sheets 16 is disposed below the pressure developing unit 13. Developer sheets 16 are taken out of the cassette 17, one at a time, by a developer sheet supplying device 18 which attracts the developer sheet 16 under suction. The developer sheet 16 which is taken from the cassette 17 is delivered by a feed roller 19a and a pinch roller 19b. After the leading end of the developer sheet 16 is aligned by rollers 19c, 19d and a resist gate 19e, the developer sheet 16 is fed into an inlet slot of the pressure developing unit 13.

The microcapsule sheet 11 and developer sheet 16 are closely held against each other when they are introduced into the pressure developing unit 13. The pressure developing unit 13 includes a smaller-diameter roller 13a and a backup roller 13b. The microcapsule sheet 11 and the developer sheet 16 are sandwiched and pressed together between the smaller-diameter roller 13a and the backup roller 13b. At this time, a microcapsule layer on the microcapsule sheet 11 with the latent image formed thereon and a color developer layer on the developer sheet 16 are held against each other. Those microcapsules in the microcapsule layer which are not exposed are ruptured under pressure, and a developed image is transferred onto the developer sheet 16.

The microcapsule sheet 11 and the developer sheet 16 which have passed through the pressure developing unit 13 are fed by the rollers 14c. Then, the microcapsule sheet 11 is separated from the developer sheet 16 by the separator roller 14d. The microcapsule sheet 11 is directed upwardly, whereas the developer sheet 16 travels straight ahead into a thermal fixing unit 20. The thermal fixing unit 20 comprises a heated roller 20a and a feed roller 20b. After color development on the developer sheet 16 is promoted and the color image is fixed by the thermal fixing unit 20, the developer sheet 16 is discharged into a tray 21 with the developed image facing up.

The separated microcapsule sheet 11 travels past the adjustment roller 14e and is wound around the takeup reel 15.

The developer sheet supplying device 18 will be described in greater detail with reference to FIGS. 4 and 5.

The developer sheet supplying device 18 includes a pair of suction cups 31 mounted on an angularly movable elevator arm 32 by means of an attachment plate 32a. The elevator arm 32 has two pivot shafts 34 (one of which is shown in FIG. 4) rotatably supported on elevator frames 36 vertically movably mounted on machine side plates 35 (one of which is shown in FIG. 4). The pivot shafts 34 about which the suction cups 31 are angularly movable are disposed in a plane which contains the suction surfaces of the suction cups 31. The pivot shafts 34 are positioned behind, or upstream, of the position where the suction cups 31 attract the developer sheet 16, with respect to the direction in which the color developer sheet 16 is fed from the cassette 17.

The suction cups 31 are positioned such that they attract the developer sheet 16 at its relatively forward portion in the direction of feed of the developer sheet 16. An uppermost sheet sensor 33 which may comprise a microswitch, for example, is mounted on the elevator arm 32 by means of an attachment plate 32b extending from and inclined at an angle to the attachment plate 32a. When the attachment plate 32b extends vertically, the sensor 33 and the pivot shafts 34 are disposed in a common horizontal plane.

A stepper motor 37 is mounted on one of the frames 36, and a gear 38 rotatable by the stepper motor 37 is also supported on the frame 36. The gear 38 is held in mesh with a swing gear 39 fixed to the pivot shaft 34. Therefore, when the stepper motor 37 is energized, the elevator arm 32 is angularly moved about the pivot shafts 34 in the directions indicated by the arrows A, B (FIG. 4).

Each of the frames 36 is supported by a vertical guide mechanism (not shown), and can be moved vertically in the direction indicated by the arrows C, D (FIG. 4) by a stepper motor 40. Shafts 41, 42 mounted on the machine side plate 35 extend through respective vertical slots 43, 44 defined in the frame 36. Gears 45, 46 fixed to the shafts 41, 42 respectively, are held in mesh with racks 47, 48 defined on edges of the slots 43, 44. A timing belt 51 is trained around pulleys 49, 50 fixed respectively to the shafts 41, 42. A helical gear 52 fixed to the end of the shaft 41 is held in mesh with a worm gear 53 fixed to output shaft of the stepper motor 40.

Each of the suction cups 31 has an inner hole defined in its bottom and connected through a flexible tube 54 to an evacuating unit 55 mounted on the other machine side plate. The evacuating unit 55 comprises a cylinder 56, a piston 58 having an O-ring 57 and slidably fitted in the cylinder 56, intermeshing gears 59, 60 and a stepper motor 61. When the stepper motor 61 is energized, the gear 60 mounted on the output shaft of the stepper motor 61 causes the gear 59 to rotate about a shaft 62. A pin 63 is disposed on the gear 59 near an outer peripheral surface thereof and fitted in a slot defined in one end of a piston rod 64 joined to the piston 58. Therefore, the gear 59 causes the piston 58 to move in the cylinder 56 in the direction indicated by the arrow E, thereby developing a vacuum in the cylinder 56 which is connected to the tube 54.

Figure 4:
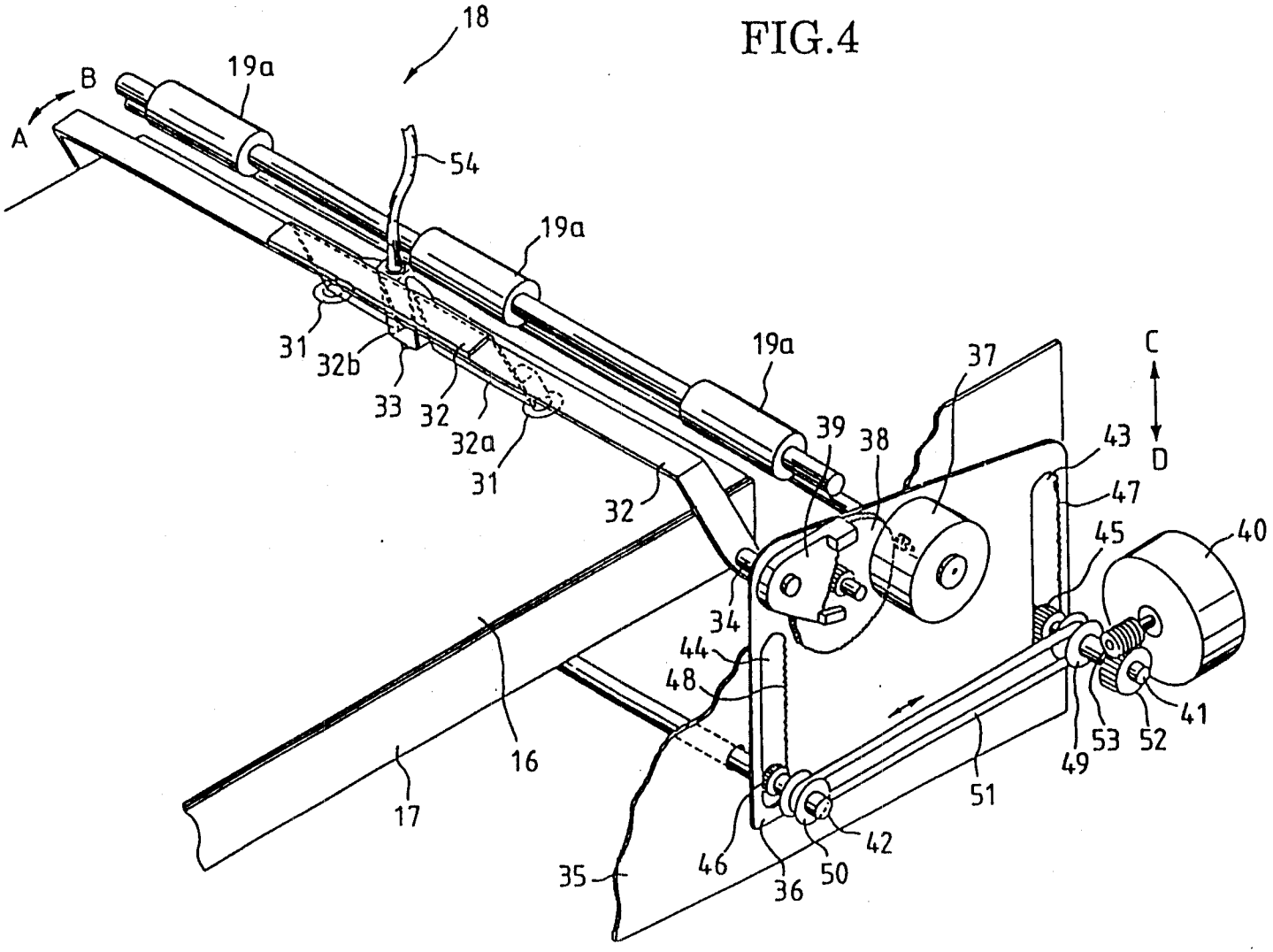
FIG. 4 is a enlarged fragmentary perspective view showing the sheet supplying device.

The feed roller 19*a*, which is shown as a plurality of feed rollers 19*a* in FIG. 4, is disposed upwardly of the leading edges of the developer sheets 16 stacked in the cassette 17. The feed rollers 19*a* are rotated by a motor 24 (shown in FIG. 6). The pinch roller 19*b* is movable toward and away from the feed roller 19*a* and rotatably supported on the distal ends of swing arms 72 (one shown in FIG. 5) which are angularly movable about a shaft 71 in the directions indicated by the arrows G, H. The swing arms 72 are angularly moved by a motor 23 (shown in FIG. 6) each time a developer sheet 16 is to be fed out of the cassette 17, to move the pinch roller 19*b* toward and away from the feed roller 19*a*. A guide member 73 is disposed downstream of the rollers 19*a*, 19*b* with respect to the direction of feed of the developer sheets 16, the guide member 73 defining a sheet feed path. The rollers 19*c*, 19*d* and the resist gate 19*e* are also disposed downstream of the rollers 19*a*, 19*b*. The resist gate 19*e* comprises an end of a lever 74 rotatable about a shaft 74*a*. The roller 19*d* is supported on the other end of the lever 74. The roller 19*d* and the resist gate 19*e* are angularly moved by a solenoid 25 (shown in FIG. 6) alternatively between the solid-line position and the two-dot-and-dash-line position in FIG. 5.

Figure 7:
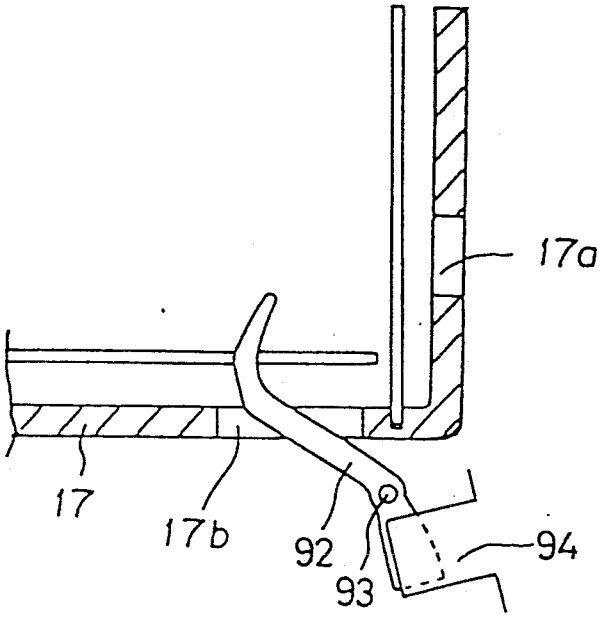
FIG. 7 is a side elevational view showing the movement of an "empty" sensor of the copying machine.

Further, an empty sensor ES for detecting the presence of the developer sheet 16 is mounted in the right lower corner of the sheet cassette 17 as shown in FIG. 7. That is, holes 17*a*, 17*b* are formed on the side and the bottom of the cassette 17. And a L-shaped lever 92 is rotatably supported by a pin 93, such that the lever 92 is able to pass through the holes 17*a*, 17*b*. The lever 92 is urged to rotate counterclockwise as shown in FIG. 5 by an urging member(not shown). A photo sensor 94 which includes a light emitting diode and a photo transistor is arranged to face the bottom of the lever 92. And, the lever 92 is rotated counterclockwise as shown in FIG. 7 when all developer sheets 16 stacked in the sheet cassette 17 have been fed out. The bottom of the lever 92 is inserted in the photo sensor 94, and shuts out the light emitted by the light emitting diode of the photo sensor 94. At this time, the photo transistor of the photo sensor 94 outputs the signal which indicates that the sheet cassette 17 is empty.

Figure 6:
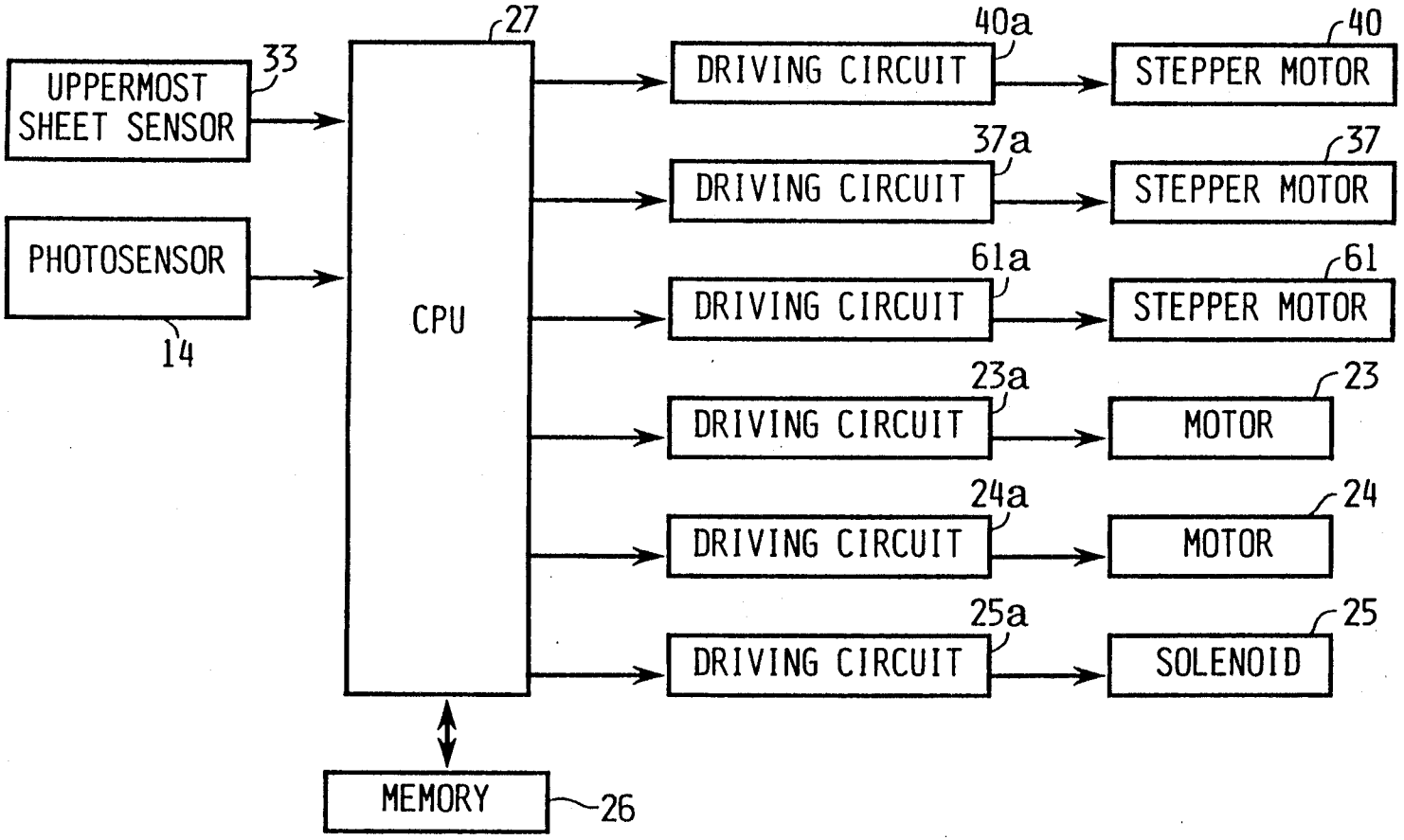
FIG. 6 is a block diagram of a control system used for the sheet supplying device.

The control system of the developer sheet supplying device 18 is explained referring to FIG. 6. A memory 26 in which the control program of the developer sheet supplying device 18 is stored, the uppermost sheet sensor 33, a photo sensor 94, various motor driving circuits 40*a*, 37*a*, 61*a*, 23*a*, 24*a*, and a solenoid driving circuit 25*a* are connected to a CPU27. The motor driving circuit 40*a*, 37*a*, 61*a*, 23*a*, and 24*a* are connected respectively to a stepper motor 40 for moving elevator frames 36, a stepper motor 37 for swinging the elevator arm 32, a stepper motor 61 for moving the piston 58, a motor 23 for swinging the swing arms 72, and a motor 24 for rotating the feed rollers 19*a*. Further, the solenoid driving circuit 25*a* is connected to a solenoid 25 for swinging the lever 74.

Figure 1:
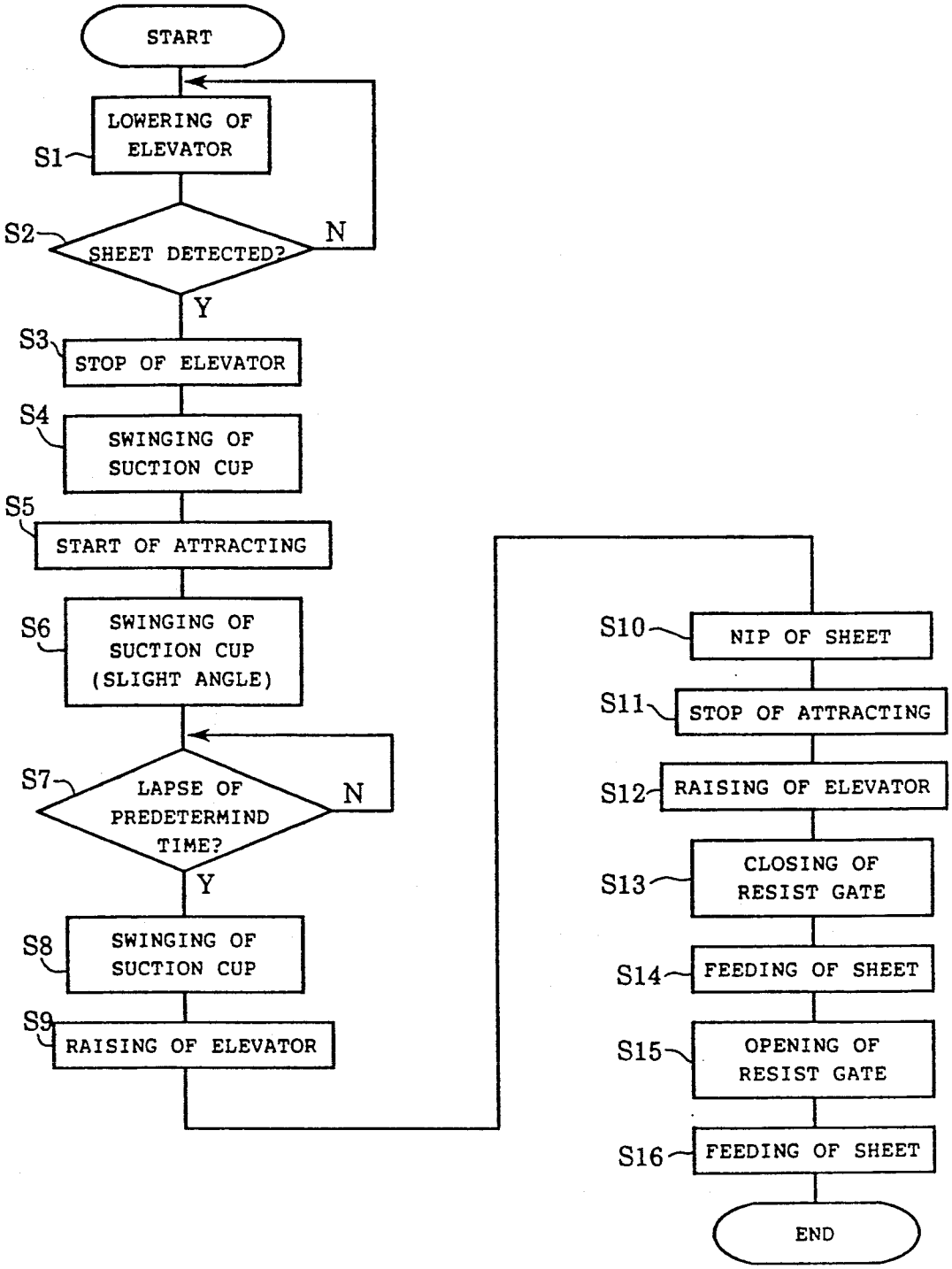
FIG. 1 is a flowchart showing the movement of a sheet supplying device which is one embodiment of this invention.
Figure 2:
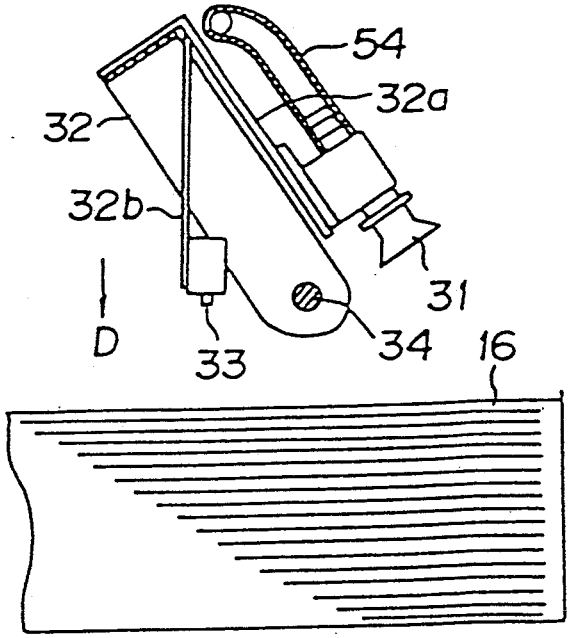
FIGS. 2(A) through 2(E) are sectional side elevational view showing a series of sheet supplying operations of the sheet supplying device.
Figure 2:
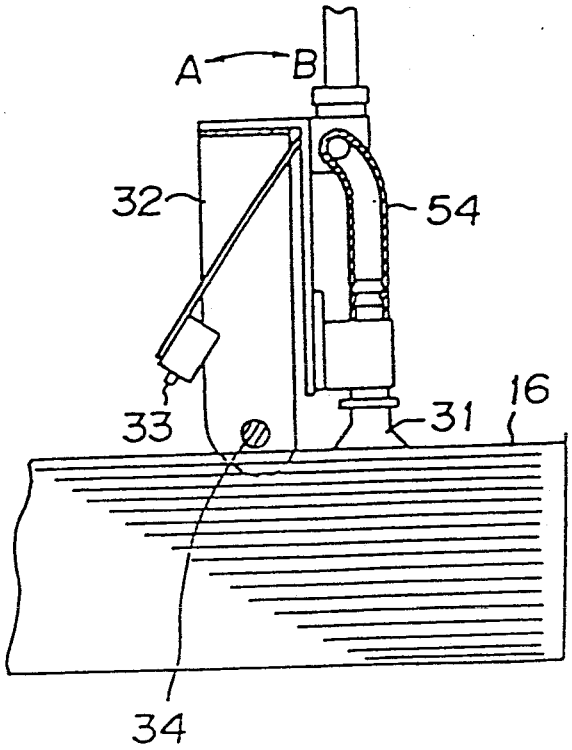
Figure 2:
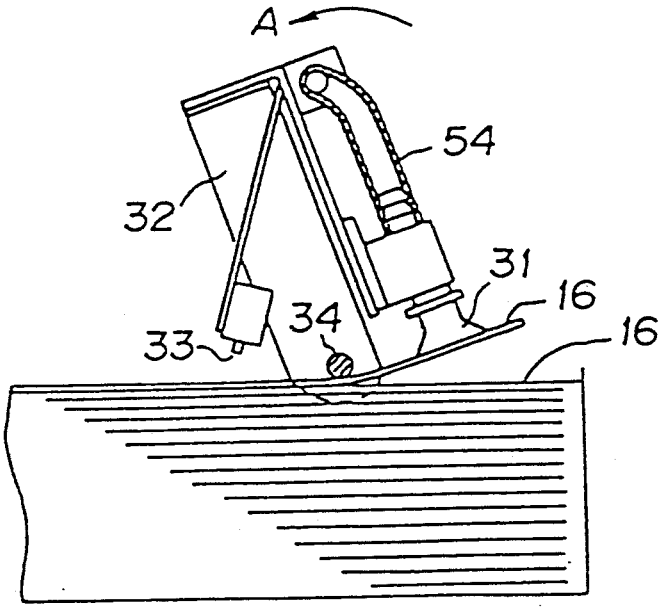
Figure 2:
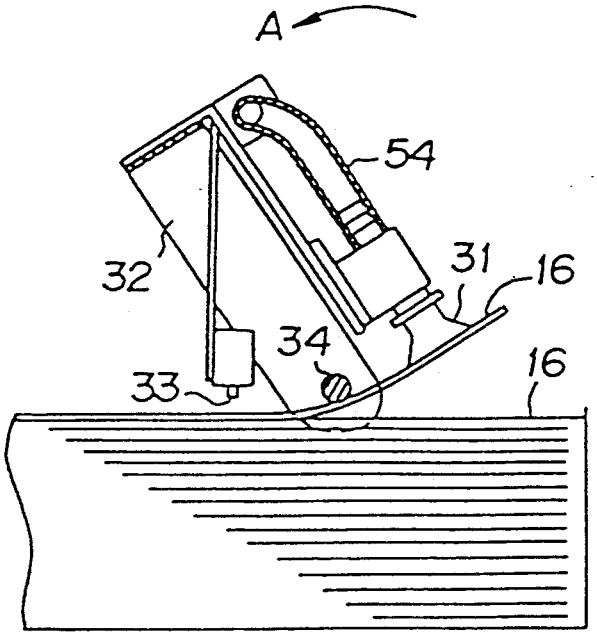

Next, the sequence of the sheet supplying operations of the developer sheet supplying device 18 is explained with reference to FIG. 1, FIGS. 2(A) through 2(E) and FIG. 4. However, the empty sensor ES is not shown in FIG. 2. When the sheet supplying signal is supplied to the developer sheet supplying device 18 from the copying machine 1, The CPU27 drives the stepper motor 40 through the motor driving circuit 40*a*. The shaft 41 is rotated by the stepper motor 40 through the worm 53 and the helical gear 52. The gear 45 is rotated clockwise as shown in FIG. 4 by the rotation of the shaft 41, and the gear 46 fixed to the shaft 42 is also rotated at the same time and in the same direction through the pulley 49, the timing belt 51, and the pulley 50. The elevator frames 36 are moved downwardly in the direction of the arrow D through racks 47, 48 engaged with the gears 45,46 (step S1). At this time, as shown in FIG. 2(A), the attachment plate 32*b* of the rotatable arm 32 supported on the elevator frames 36 is oriented perpendicularly. Therefore, the tip of the sensor 33 mounted on the attachment plate 32*b* faces the developer sheet 16 for detecting the uppermost developer sheet 16.

When the sensor 33 comes in contact with the developer sheet 16 and detects the developer sheet 16 (step S2), the CPU27 stops the rotation of the stepper motor 40, thereby stopping the elevator frames 36 (step S3). Next, the CPU27 drives the stepper motor 37 through the motor driving circuit 37*a*. The rotatable arm 32 is swung by the stepper motor 37 in the direction of arrow B shown in FIG. 2(B) (step S4) through the gear 38, the swing gear 39, and the pivot shaft 34. Then, the suction cups 31 are located in the same plane as the pivot shaft 34, and it becomes possible to attract the uppermost developer sheet 16. In this state, the CPU27 drives the stepper motor 61 of the evacuating unit 55 (refer to FIG. 5) through the motor driving circuit 61*a*. The piston 58 is moved in the direction of the arrow E by the stepper motor 61 through the gears 59, 60, a negative pressure is generated in the suction cups 31, and the uppermost developer sheet 16 is attracted by the suction cups 31 (step S5).

After that, the CPU27 drives the stepper motor 37 to the direction opposite to the direction in the step 4. The rotatable arm 32 is rotated around the pivot shaft 34 through a small angle (2–3 degrees) in the direction of the arrow A as shown in FIG. 2(C), and the edge of the developer sheet 16 attracted by the suction cups 31 is slightly raised (step S6). The CPU27 stops the stepper motor 37 for several seconds (step S7). Even if a plurality of developer sheets 16 are raised with the uppermost developer sheet 16 by static attraction or other slight adhesion, only the uppermost developer sheet 16 remains separated after this several seconds, since the other sheets 16 fall by elastic force and gravity back onto the stack of the developer sheets. Afterwards, the CPU27 drives the step motor 37 again and the arm 32 is rotated in the direction of the arrow A by a predetermined angle as shown in FIG. 2(D) (step S8).

Figure 2E:
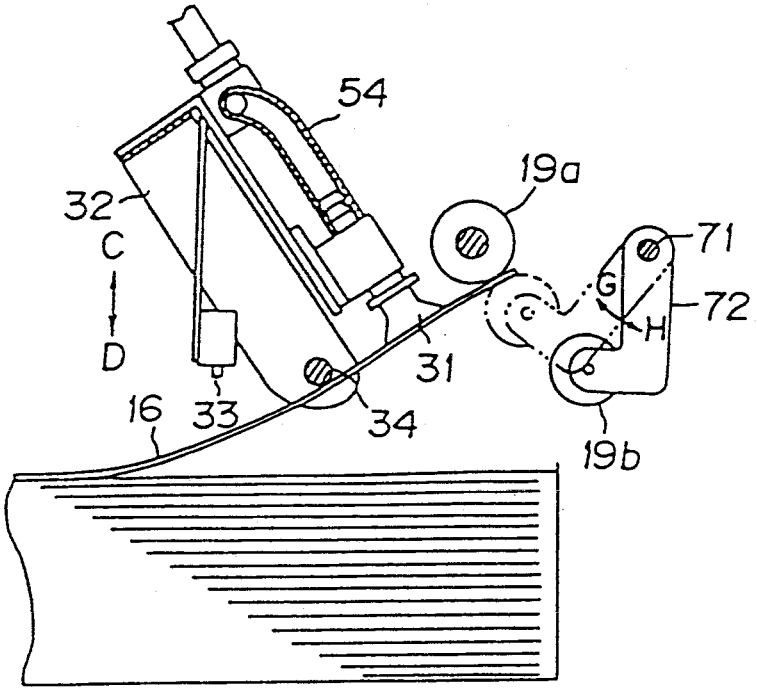

After the uppermost developer sheet 16 is separated as mentioned above, as shown in FIG. 2(E), the CPU27 drives the stepper motor 40 to the direction opposite to the direction in step 1, and the arm 32 is raised to a predetermined position in the direction of the arrow C (step S9), so that the leading end of the developer sheet 16 touches on the lower surface of the feed roller 19*a*. Next, the CPU27 drives the motor 23 through the motor driving circuit 23*a*, so that the pinch roller 19*b* supported by the swing arms 72 is swung in the direction of the arrow G as shown in FIG. 2(E) with the two-dot-and-dash-line. Thus, the leading end of the developer sheet 16 is held between the pinch roller 19*b* and the feed roller 19*a* (step S10).

Figure 5:
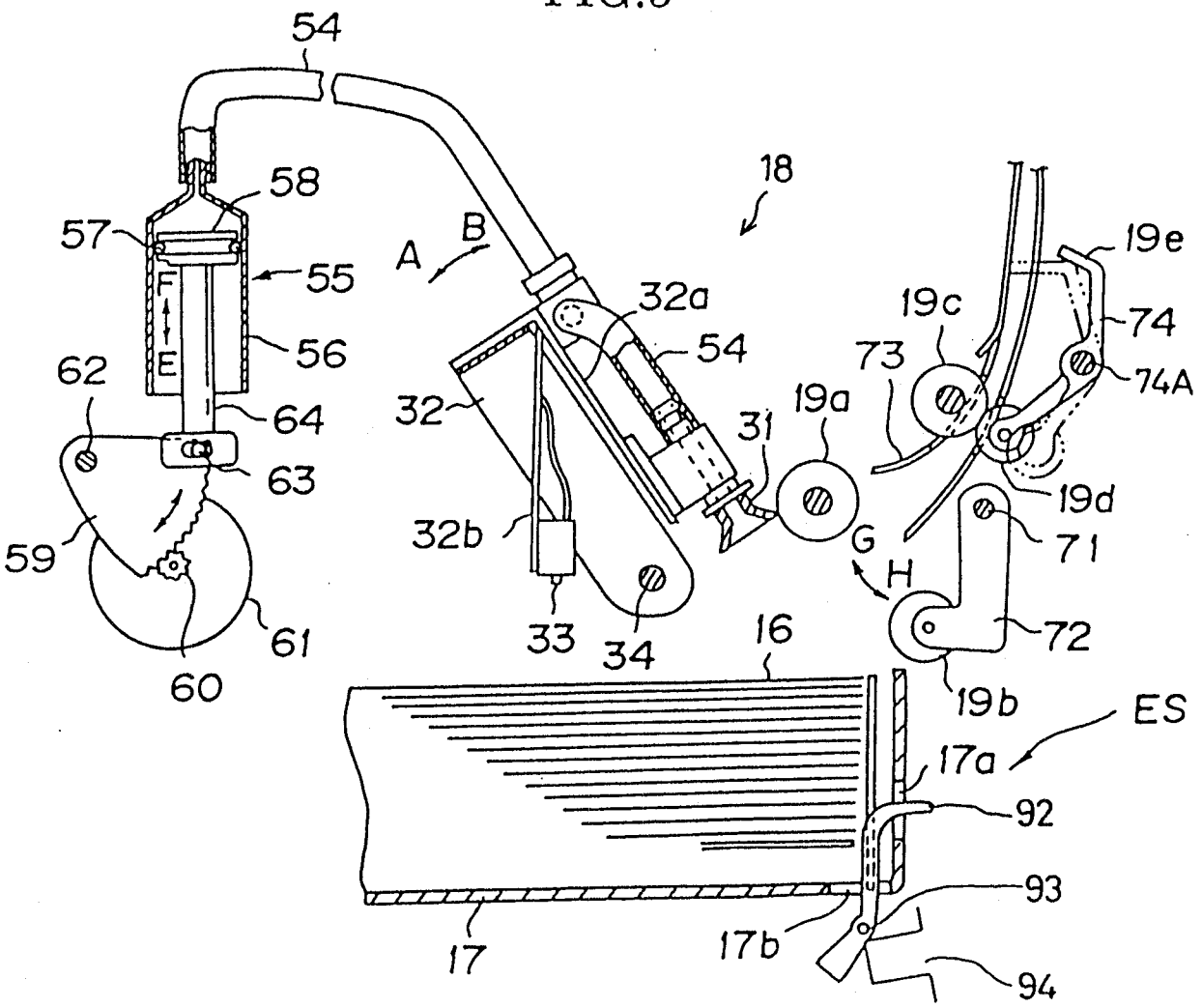
FIG. 5 is a side elevational view, partly cut away, showing the sheet supply mechanism of the sheet supplying device.

Afterwards, the CPU27 drives the step motor 61 of the evacuating unit 55 to the direction opposite to the direction in the step 5, so that the piston 58 is moved in the direction of the arrow F shown in FIG. 5. The attracting of the developer sheet 16 by the suction cups 31 is stopped, and the developer sheet 16 is separated from the suction cups 31 (step S11). Further, the CPU27 drives the step motor 40, so that the elevator frames 36 and the elevator arm 32 are raised by a predetermined amount, and the suction cups 31 are separated from the developer sheet 16 (step S12).

Next, the CPU27 drives the solenoid 25 through the solenoid driving circuit 25*a*, so that the lever 74 is rotated to the position indicated by the two-dot-and-dash-line shown in FIG. 5, and the resist gate 19*e* is inserted into the feeding path of the developer sheet 16 (step S13). The CPU27 drives the motor 24 through the motor driving circuit 24*a* and the feed roller 19*a* is rotated. The developer sheet 16 is fed by the feed roller 19*a* and the pinch roller 19*b* until the leading end of developer sheet 16 touches the resist gate 19*e*, so that the leading end of the developer sheet 16 is positioned orthogonally to the sheet feeding direction (step S14). Next, the CPU27 drives the solenoid 25 after a predetermined time, and the lever 74 is rotated to the position indicated with the solid line in FIG. 5. Accordingly, the resist gate 19*e* is removed from the feeding path of the developer sheet 16, and the roller 19*d* is brought into engagement with the roller 19*c* (step S15). The developer sheet 16 is then fed by the rollers 19*a*, 19*b*, 19*c* and 19*d* (step S16).

As mentioned in detail in the above, according to this embodiment, it is possible to separate the uppermost developer sheet 16, to take out the uppermost developer sheet 16 from the sheet cassette 17 one by one, and to prevent feeding a plurality of the developer sheets. Moreover, when only a few developer sheets remain in the sheet cassette 17, all the developer sheets are sometimes raised with the uppermost sheet 16 by the suction cups 31. However, in this embodiment, the suction cups 31 stop once in the position where they are slightly swung. At this state, since the L-shaped lever 92 contacts with the raised developer sheet, the rotating of the lever 92 is prevented. During the time movement of the suction cups 31 is initially stopped, all except the uppermost sheet 16, fall back into the sheet cassette 17. As a result, the empty sensor ES does not operate by mistake when only a few sheets remain in the sheet cassette 17.

What is claimed is:

1. A sheet supplying device comprising:

a sheet cassette for stacking sheets;

a suction cup movable into and out of contact with the uppermost sheet in said sheet cassette;

evacuating means for developing a negative pressure in said suction cup to enable said suction cup to attract the uppermost sheet;

elevator means for moving said suction cup upwardly and downwardly;

first control means for controlling said elevator means to move said suction cup downwardly until said suction cup contacts with the uppermost sheet of the sheets stacked in said sheet cassette;

second control means for controlling said elevator means to raise said suction cup slightly and then to stop said suction cup temporarily, the second control means comprising means for maintaining said suction cup in said slightly raised position for a predetermined period of time, said predetermined period of time at least equal to the time for a picked-up sheet to return to said sheet cassette from said slightly raised position; and third control means for controlling said elevator means to raise said suction cup to a predetermined position.

2. Apparatus as in claim 1, further comprising feeding means for feeding the sheet into a feed path and fourth control means for controlling the feeding means when the suction cup is raised to said predetermined position.

3. Apparatus as in claim 2, further comprising means for positioning a sheet fed by the feeding means in the feed path.

4. Apparatus as in claim 3, wherein the sheet positioning means comprises a resist gate and fifth control means for controlling the positioning of the resist gate between a sheet blocking and a sheet releasing position.

5. Apparatus as in claim 1, wherein the elevator means includes means for swinging the suction cup and the second control means controls the swinging means to raise the suction cup slightly.

6. Apparatus as in claim 1, further comprising detector means for indicating the absence of sheets in the sheet cassette, said detector means including means for sensing the absence of sheets in the sheet cassette after all of the sheets in the cassette are raised beyond said slightly raised position by the second control means.

7. Apparatus as in claim 6, wherein the detector means comprises a swingable arm;

the swingable arm includes a sheet engaging portion positioned to bear against at least a lowermost sheet in the sheet cassette; and the sheet engaging portion of the arm is positioned to engage the lowermost sheet positioned in the sheet cassette and the slightly raised position by the second control means.

8. A sheet supplying device comprising:

a sheet cassette for stacking sheets;

a suction cup movable into and out of contact with the uppermost sheet in said sheet cassette;

evacuating means for developing a negative pressure in said suction cup to enable said suction cup to attract the uppermost sheet;

swinging means for swinging said suction cup about an axis;

first control means for controlling said swinging means to swing said suction cup in a first rotational direction until said suction cup contacts with the uppermost sheet of the sheets stacked in said sheet cassette;

second control means for controlling said swinging means to swing said suction cup slightly in a second rotational direction opposite to the first rotational direction and then to stop said suction cup temporarily, whereby said suction cup is slightly raised;

third control means for controlling said swinging means to swing said suction cup in the second rotational direction from the position where said suction cup is temporarily stopped to a predetermined position; and detector means for indicating the absence of sheets in the sheet cassette, said detector means including means for sensing the absence of sheets in h sheet cassette after all of the sheets in the sheet cassette are raised above said slightly raised position by the second control means.

9. Apparatus as in claim 8, wherein the second control means includes means for maintaining the suction cup in said slightly raised position for a predetermined period of time.

10. Apparatus as in claim 8, further comprising feeding means for feeding the sheet into a feed path and fourth control means for controlling the feeding means when the suction cup is raised to said predetermined position.

11. Apparatus as in claim 10, further comprising means for positioning a sheet fed by the feeding means in the feed path.

12. Apparatus as in claim 11, wherein the sheet positioning means comprises a resist gate and fifth control means for controlling the positioning of the resist gate between a sheet blocking and a sheet releasing position.

13. Apparatus as in claim 8, further comprising means for linearly raising the suction cup.

14. Apparatus as in claim 13, further comprising fourth control means for causing the raising means to raise the suction cup after the third control means has positioned the suction cup in said predetermined position.

15. Apparatus as in claim 14, further comprising:

a frame;

mounting means for mounting the frame for swinging movement with respect to the sheet cassette;

means for mounting the suction cup on the frame; and means for moving the frame mounting means for movement toward and away from the sheet cassette.

16. Apparatus as in claim 8, wherein the detector means comprises a swingable arm;

the swingable arm includes a sheet engaging portion positioned to bear against a lowermost sheet in the sheet cassette; and the sheet engaging portion of the arm is positioned to engage the lowermost sheet positioned in the sheet cassette and the slightly raised position by the second control means.

17. Apparatus as in claim 16, further comprising:

an opening in the sheet cassette; and means for pivotally mounting said swingable arm adjacent the opening with the sheet engaging portion of the arm disposed within the cassette.

18. A method of supplying a sheet from a sheet cassette stacking sheets by a suction cup movable into and out of contact with the uppermost sheet in the sheet cassette comprising:

moving the suction cup downwardly until the suction cup contacts the uppermost sheet in the sheet cassette;

developing a negative pressure in the suction cup, so as to enable the suction cup to attract the uppermost sheet;

raising the suction cup slightly;

stopping the suction cup temporarily at the position where the suction cup is slightly raised; and raising the suction cup from the position where the suction cup is temporarily stopped to a predetermined position by tilting the suction cup a further amount and moving the tilted suction cup away from the sheet cassette.

19. A method as in claim 18, wherein the step of raising the suction cup slightly comprises tilting the suction cup.

* * * * *

UNITED STATES PATENT AND TRADEMARK OFFICE

CERTIFICATE OF CORRECTION

PATENT NO. : 5,075,939

DATED : December 31, 1991

INVENTOR(S) : Michitoshi Akao and Takashi Nakata

It is certified that error appears in the above-identified patent and that said Letters Patent is hereby corrected as shown below:

On the title page, item (75) change "Akao Michitoshi" to --Michitoshi Akao--.

Item (19) change "Michitoshi" to --Akao et al.--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*